US011871786B2

(12) United States Patent
Courbat et al.

(10) Patent No.: US 11,871,786 B2
(45) Date of Patent: Jan. 16, 2024

(54) AEROSOL-GENERATING DEVICE HAVING A MOVABLE COMPONENT FOR TRANSFERRING AEROSOL-FORMING SUBSTRATE

(71) Applicant: Philip Morris Products S.A., Neuchatel (CH)

(72) Inventors: Jerome Christian Courbat, Neuchatel (CH); Oleg Mironov, Neuchatel (CH); Enrico Stura, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 593 days.

(21) Appl. No.: 16/972,183

(22) PCT Filed: Jun. 6, 2019

(86) PCT No.: PCT/EP2019/064884
§ 371 (c)(1),
(2) Date: Dec. 4, 2020

(87) PCT Pub. No.: WO2019/234195
PCT Pub. Date: Dec. 12, 2019

(65) Prior Publication Data

US 2021/0235759 A1 Aug. 5, 2021

(30) Foreign Application Priority Data

Jun. 6, 2018 (EP) ..... 18176362

(51) Int. Cl.
*A24F 13/00* (2006.01)
*A24F 40/44* (2020.01)
(Continued)

(52) U.S. Cl.
CPC ..... *A24F 40/44* (2020.01); *A24F 40/42* (2020.01); *A24F 40/46* (2020.01); *A24F 40/48* (2020.01); *A24F 40/53* (2020.01); *A24F 40/10* (2020.01)

(58) Field of Classification Search
CPC ..... A24F 47/00
(Continued)

(56) References Cited

U.S. PATENT DOCUMENTS 5,269,327 A * 12/1993 Counts ..... A24F 40/30 131/194
2007/0256697 A1 11/2007 Yang
(Continued)

FOREIGN PATENT DOCUMENTS

CA 2 970 843 A1 6/2017
CN 103889258 A 6/2014
(Continued)

OTHER PUBLICATIONS

International Search Report and Written Opinion dated Sep. 25, 2019 in PCT/EP2019/064884 filed Jun. 6, 2019.
(Continued)

*Primary Examiner* — Phuong K Dinh
(74) *Attorney, Agent, or Firm* — Oblon, McClelland, Maier & Neustadt, L.L.P.

(57) ABSTRACT

An aerosol-generating device is provided, including a storage container containing a liquid aerosol-forming substrate; a heating element spaced from the container for vaporising the substrate to form an aerosol; a transfer element between the container and the heating element to receive and retain the substrate, and to be coupled with the heating element to supply the received substrate to the heating element, at least one of the transfer element and the heating element being movable between a loading position and a heating position,
(Continued)

such that when the movable element is in the loading position, the transfer element is in fluid communication with the outlet of the container and/or with the heating element, and such that when the movable element is in the heating position, the transfer element is in fluid communication with the heating element and the heating element is activated to vaporise the substrate retained in the transfer element.

12 Claims, 2 Drawing Sheets

(51) Int. Cl.

| | |
|---|---|
| ***A24F 40/53*** | (2020.01) |
| ***A24F 40/48*** | (2020.01) |
| ***A24F 40/46*** | (2020.01) |
| ***A24F 40/42*** | (2020.01) |
| *A24F 40/10* | (2020.01) |

(58) Field of Classification Search
USPC ..... 131/328–329
See application file for complete search history.

(56) References Cited

U.S. PATENT DOCUMENTS

| | | | |
|---|---|---|---|
| 2014/0346689 | A1 | 11/2014 | Dubief |
| 2015/0027470 | A1 | 1/2015 | Kane et al. |
| 2016/0255880 | A1 | 9/2016 | Dubief |
| 2017/0367409 | A1 | 12/2017 | Thorens et al. |
| 2018/0168238 | A1 | 6/2018 | Kane et al. |

FOREIGN PATENT DOCUMENTS

| | | | |
|---|---|---|---|
| CN | 103974635 | A | 8/2014 |
| CN | 105916395 | A | 8/2016 |
| JP | 2017-537637 | A | 12/2017 |
| RU | 2 615 960 | C2 | 4/2017 |
| RU | 2 638 514 | C2 | 12/2017 |
| RU | 2 653 675 | C1 | 5/2018 |
| WO | WO 2013/083634 | A1 | 6/2013 |
| WO | WO 2015/013126 | A2 | 1/2015 |
| WO | WO 2016/096912 | A1 | 6/2016 |
| WO | WO 2016/156213 | A1 | 10/2016 |
| WO | WO 2018/153732 | A1 | 8/2018 |

OTHER PUBLICATIONS

Russian Office Action dated Sep. 23, 2022 in Russian Patent Application No. 2020139810 (with English translation), 9 pages.
Russian Search Report dated Sep. 23, 2022 in Russian Patent Application No. 2020139810 (with English translation), 4 pages.
Japanese Office Action dated Apr. 17, 2023 in Japanese Patent Application No. 2020-564116 (with English Translation), 12 pages.
Chinese Office Action and Search Report dated Aug. 30, 2023 issued in Chinese Patent Application No. 201980032184.0 filed on Jun. 6 2019, with English Translation, total 11 pages.

* cited by examiner

AEROSOL-GENERATING DEVICE HAVING A MOVABLE COMPONENT FOR TRANSFERRING AEROSOL-FORMING SUBSTRATE

CROSS-REFERENCE TO RELATED APPLICATIONS

This application is a U.S. national stage application of PCT/EP2019/064884, filed on Jun. 6, 2019, which is based upon and claims the benefit of priority from European patent application no. 18176362.4, filed Jun. 6, 2018, the entire contents of each of which are incorporated herein by reference.

TECHNICAL FIELD

The present invention relates to an aerosol-generating device that operates by heating an aerosol-forming substrate. In particular, the invention relates to handheld aerosol-generating devices which vaporise a liquid aerosol-forming substrate by heating to generate an aerosol for inhalation by a user.

DESCRIPTION OF THE RELATED ART

In aerosol-generating devices wherein a liquid aerosol-forming substrate is heated to generate an aerosol, it is known to provide an electric heater comprising at least one resistive heating element arranged to heat the aerosol-forming substrate. A supply of the liquid aerosol-forming substrate is held in a storage tank and directed along a liquid supply path towards the heating element. In order to supply a correct amount of liquid aerosol-forming substrate irrespective of the position of the storage tank reported to gravity, it is known to provide a high retention material (HRM) with capillary properties at an exit of the storage tank and in contact with the heating element.

Typically, when a user activates the device, for example, by pressing a button or inhaling through the device, an electric current passes through the heating element and causes resistive heating which vaporises the liquid in the HRM. The device has inlet and outlet openings and is held within an airflow path so that air is drawn past the HRM and entrains the vapour. The vapour subsequently cools to form an aerosol.

However, when—during a puff of the user—electric current is supplied to the heating element to heat the HRM and vaporise the liquid aerosol-forming substrate, the heating element may also heat, by conduction and convection, the rest of the liquid aerosol-forming substrate in the storage tank. This is undesirable in that it may alter the properties and quality of the liquid aerosol-forming substrate. Further, the overall energy efficiency of the device may be impacted. In addition, this may undesirably impact on the number of puffs for a given quantity of liquid aerosol-forming substrate in the storage tank.

It would be desirable in such electrically operated aerosol-generating devices to ensure that, during a puff of the user, only the predetermined portion of liquid aerosol-forming substrate that should be vaporised during such puff be heated.

SUMMARY

According to an aspect of the present invention, there is provided an aerosol-generating device comprising: a storage container containing a supply of a liquid aerosol-forming substrate, the storage container having an outlet; a heating element spaced from the storage container, the heating element adapted to vaporise the liquid aerosol-forming substrate to form an inhalable aerosol; a transfer element located between the storage container and the heating element, the transfer element adapted to receive and retain liquid aerosol-forming substrate from the storage container and capable of being operatively coupled with the heating element to supply the received liquid aerosol-forming substrate to the heating element. At least one of the transfer element and the heating element is movable between a loading position and a heating position, wherein the aerosol-generating device is configured such that: when the at least one of the transfer element and the heating element is in the loading position, the transfer element is in fluid communication with the outlet of the storage container or with the outlet of the storage container and with the heating element; and when the at least one of the transfer element and the heating element is in the heating position, the transfer element is in fluid communication with the heating element and the heating element is activated to vaporise liquid aerosol-forming substrate retained in the transfer element.

BRIEF DESCRIPTION OF THE DRAWINGS

The invention will now be further described with reference to the figures in which.

DETAILED DESCRIPTION

Figure 1:
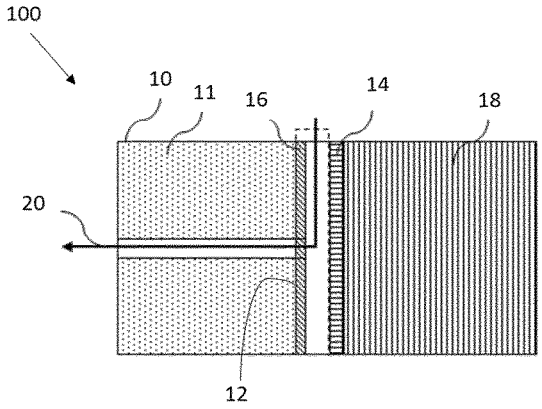
FIG. 1 shows a schematic, sectional side view of a detail of an aerosol-generating device according to an embodiment of the present invention in the loading position.

As used herein, the term "aerosol-generating device" relates to a device that interacts with an aerosol-forming substrate to generate an aerosol.

As used in the context of the present invention, the term "aerosol-generating substrate" relates to a substrate capable of releasing volatile compounds that can form an aerosol. Such volatile compounds may be released by heating the aerosol-forming substrate. An aerosol-forming substrate may conveniently be part of an aerosol-generating article or smoking device.

The aerosols generated from aerosol-forming substrates of aerosol-generating devices according to the invention may be visible or invisible and may include vapours (for example, fine particles of substances, which are in a gaseous state, that are ordinarily liquid or solid at room temperature) as well as gases and liquid droplets of condensed vapours.

As used herein, the term "longitudinal" refers to the direction corresponding to the main longitudinal axis of the aerosol-generating device, which extends between the upstream and downstream ends of the aerosol-generating device. During use, air is drawn through the aerosol-generating device in the longitudinal direction. The term "length"

denotes the dimension of a component of the aerosol-generating device in the longitudinal direction.

The term "transverse" refers to the direction that is perpendicular to the longitudinal axis. Any reference to the "cross-section" of the aerosol-generating device or a component of the aerosol-generating device refers to the transverse cross-section unless stated otherwise.

As used herein, the terms "upstream" and "downstream" describe the relative positions of elements, or portions of elements, of the aerosol-generating device in relation to the direction in which the aerosol is transported through the aerosol-generating device during use.

Within the meaning of the present specification, the term "radial" is used to describe the direction identified by a line of a set of straight lines extending in a plane perpendicular to the longitudinal axis and passing through the point at which the longitudinal axis intersects the perpendicular plane. Thus, the term "radial direction" generally identifies a direction perpendicular to the longitudinal axis and is used, in particular, when describing an aerosol-generating device having a substantially cylindrical shape.

As used herein, the term "liquid flow path" refers to a portion of a route along which a liquid flows or is otherwise transferred, whether in a housing, in or on a non-porous component or material, in or on a porous-component or material or any combination thereof. The liquid flow path may be at least partly defined by fluid passages, chambers, channels, conduits, matrices or other structures in which or through which a liquid can travel. In an aerosol-generating device in accordance with the present invention, a liquid flow path can always be identified, at any time and in any configuration, between an outlet of the storage container, which holds a supply of a liquid aerosol-forming substrate, and the heating element which is operated to vaporise aerosol-forming substrate to form an inhalable aerosol. Because in an aerosol-generating device in accordance with the invention at least one of the transfer element, the heating element and the storage container is movable, a physical distance between any two of such components may change over time and in different configurations of the device. Thus, an overall length of the liquid flow path extending from the outlet of the storage container to the heating element may vary over time and in different configurations of the device. By way of example, in an embodiment where the transfer element is movable coupled with the storage container, a length of the liquid flow path extending from the outlet of the storage container to the heating element will be smaller when the transfer element and the storage container are in the heating position than when the transfer element and the storage container are in the loading position.

As used herein, the terms "inhalation" and "puff" are effectively interchangeable and are intended to refer to the action of a user drawing on an end of the device to draw aerosol from the device.

In contrast to existing aerosol-generating devices, according to the present invention there is provided one such device wherein one or more of the transfer element (on its own, or integral with the storage container) and the heating element are provided as components movable between a loading position and a heating position. Thus, in practice, the invention provides for two distinct configurations of the device. When the movable component(s) is (are) in the loading position, the device is configured such that the transfer element is placed in fluid communication with the outlet of the storage container or with the outlet of the storage container and with the heating element, whereby some liquid aerosol-forming substrate can be transferred from the storage container to the transfer element. When the movable component(s) is (are) in the heating position, the device is configured such that the transfer element is in fluid communication with the heating element and the heating element is activated to vaporise liquid aerosol-forming substrate retained in the transfer element.

With the arrangement of the invention, it is advantageously possible to have only a predetermined, metered amount of the liquid aerosol-forming substrate being directly heated by the heating element, while the remainder of the supply of liquid aerosol-forming substrate is maintained at some distance from the heating element. Thus, heating by convection or conduction of the remainder of the supply of liquid aerosol-forming substrate in the storage container may be substantially prevented. Therefore, the properties and quality of the supply of liquid aerosol-forming substrate, and consequently of the aerosol formable by the device, may advantageously be preserved.

Further, because heat may selectively supplied in a controlled manner only to such predetermined, metered amount of liquid aerosol-forming substrate, it is generally possible to improve the overall energy efficiency of the aerosol-generating device.

In addition, by having only a predetermined, metered amount of liquid aerosol-forming substrate is effectively heated and vaporised with each puff, as is made possible by an aerosol-generating device in accordance with the present invention, it is easier to ensure that a given quantity of liquid aerosol-forming substrate in the storage container will last for a predetermined number of user inhalations.

As briefly described above, an aerosol-generating device in accordance with the present invention comprises a storage container containing a supply of a liquid aerosol-forming substrate, the storage container having an outlet.

The liquid aerosol-forming substrate in the storage container of a device in accordance with the present invention may comprise a tobacco-containing material comprising volatile tobacco flavour compounds which are released from the liquid upon heating. The liquid aerosol-forming substrate may comprise a non-tobacco material. The liquid aerosol-forming substrate may include water, solvents, ethanol, plant extracts and natural or artificial flavours. Preferably, the liquid aerosol-forming substrate comprises an aerosol former. Suitable aerosol formers include polyhydric alcohols or mixtures thereof, such as propylene glycol, triethylene glycol, 1,3-butanediol and glycerine. The liquid aerosol-forming substrate in the liquid storage section may comprise nicotine.

The storage container may comprise a porous carrier material, wherein the liquid aerosol-forming substrate is provided on the porous carrier material. Advantageously, providing the liquid aerosol-forming substrate on a porous carrier material may reduce the risk of the liquid aerosol-forming substrate leaking from the storage container.

The porous carrier material may comprise any suitable material or combination of materials which is permeable to the liquid aerosol-forming substrate and allows the liquid aerosol-forming substrate to migrate through the porous carrier material. Preferably, the material or combination of materials is inert with respect to the liquid aerosol-forming substrate. The porous carrier material may or may not be a capillary material. The porous carrier material may comprise a hydrophilic material to improve distribution and spread of the liquid aerosol-forming substrate. This may assist with consistent aerosol formation. The particular preferred material or materials will depend on the physical properties of the liquid aerosol-forming substrate. Examples of suitable materials are a capillary material, for example a sponge or foam material, ceramic- or graphite-based materials in the form of fibres or sintered powders, a foamed metal or plastics material, a fibrous material, for example made of spun or extruded fibres, such as cellulose acetate, polyester, or bonded polyolefin, polyethylene, terylene or polypropylene fibres, nylon fibres or ceramic. The porous carrier material may have any suitable porosity so as to be used with different liquid physical properties.

Further, an aerosol-generating device in accordance with the present invention comprises a heating element spaced from the storage container, the heating element adapted to vaporise the liquid aerosol-forming substrate to form an inhalable aerosol. In at least one example embodiment, the heating element may be formed of any suitable electrically resistive materials.

Further, the aerosol-generating device comprises a transfer element located between the storage container and the heating element, wherein the transfer element is adapted to receive and retain liquid aerosol-forming substrate from the storage container and capable of being operatively coupled with the heating element to supply the received liquid aerosol-forming substrate to the heating element. The transfer element may comprise a capillary material adapted to hold the liquid aerosol-forming substrate. The capillary material may be a capillary material with a fibrous or spongy structure or a capillary material comprising a bundle of capillaries. For example, the capillary material may comprise a plurality of fibres or threads or other fine bore tubes. The fibres or threads may be generally aligned such that the liquid aerosol-forming substrate can be conveyed towards the heating element. As an alternative, the capillary material may comprise a sponge-like or foam-like material. The structure of the capillary material forms a plurality of small bores or tubes, through which the liquid aerosol-forming substrate can be transported by capillary action. The capillary material may comprise any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. The capillary material may have any suitable capillarity and porosity so as to be used with different liquid physical properties. The liquid aerosol-forming substrate has physical properties, including but not limited to viscosity, surface tension, density, thermal conductivity, boiling point and vapour pressure, which allow the liquid aerosol-forming substrate to be transported through a capillary medium by capillary action.

Alternatively, or in addition, the transfer element may contain a carrier material for holding a liquid aerosol-forming substrate. The carrier material may be a foam, a sponge or a collection of fibres. The carrier material may be formed from a polymer or co-polymer. In one embodiment, the carrier material is a spun polymer.

In some embodiments, the transfer element is movable between the storage container and the heating element, and the aerosol-generating device is configured such that, when the transfer element is in the heating position, the transfer element is operatively coupled with the heating element and liquid aerosol-forming substrate retained in the transfer element is supplied to the heating element.

Preferably, the transfer element is movable independently of the storage container. In other words, as the transfer element moves between the loading position and the heating position, the storage container does not move with the transfer element. In addition, or as an alternative, the transfer element is movable independently of the heating element. In other words, as the transfer element moves between the loading position and the heating position, the heating element does not move with the transfer element.

More preferably, the transfer element is movable while the storage container is not. This is advantageous in that the remainder of the supply of liquid aerosol-forming substrate within the storage container is kept separate and at a distance from the heating element during the heating phase.

Without wishing to be bound by theory, it is understood that the volume between the outlet of storage container and the heating element may act, in practice, as a heat shield. This is desirable because it minimises the likelihood that, during use, heat be supplied to the remainder of the liquid aerosol-forming substrate by convection and conduction.

Even more preferably, the transfer element is movable while neither the storage container nor the heating element is movable. In practice, the transfer element alone is movable along the liquid supply path between the storage container and the heating element.

Accordingly, in such embodiments preservation of the properties of the liquid aerosol-forming substrate is advantageously particularly favoured. On the other hand, because the transfer element effectively acts as a lid or cover for the storage container, when the transfer element is moved away from the storage container, droplets of liquid aerosol-forming substrate may be undesirably released through the outlet of the storage container. In particularly preferred embodiments, use of a fluid-permeable heating element (for example, a heating element provided in the form of a mesh heater) may counter this by acting substantially as a filter.

In alternative embodiments, the transfer element is movable coupled with the storage container, the device being configured such that, when the transfer element is in the heating position, the transfer element is operatively coupled with the heating element and liquid aerosol-forming substrate is supplied from the transfer element to the heating element.

While there is a possibility that in such embodiments some heat may, during use, be supplied by conduction or convection to the remainder of the supply of liquid aerosol-forming substrate in the storage container, this arrangement advantageously minimises possible losses of aerosol-forming substrate.

Preferably, the device further comprises a power supply; a controller; and an actuator for moving the transfer element along the liquid supply path. The controller is configured to: monitor air flow at a location in the device based on detection of a change in air flow indicative of a user inhalation; power the actuator such that the transfer element moves, on its own or coupled with the storage container, from the loading position to the heating position; power the heating element to vaporise liquid aerosol-forming substrate retained in the transfer element. This is advantageous in that, in response to a user's puff on the device, the device is thus configured to automatically transfer some liquid aerosol-forming substrate to the heating position, wherein it can be heated to promptly and efficiently deliver an inhalable aerosol to the user.

More preferably, the controller is configured to supply to the heating element a predetermined amount of power, the predetermined amount of power being sufficient for the heating element to vaporise the amount of liquid aerosol-forming substrate retained in the transfer element. In other words, the controller may advantageously be configured to operate the heating element to supply an amount of thermal energy tailored to the actual, current requirement during use. Thus, power wastes are desirably reduced and, because the amount of heat generated is substantially dosed to vaporise only the content of the transfer element, the likelihood that the transfer element accumulates thermal energy that may then be transferred back to the storage container is reduced. This results in a more efficient overall power management. At the same time, the likelihood that the transfer element or the storage container may be overheated during use is significantly reduced.

In some embodiments, the controller may be configured to power the actuator such that the transfer element moves, on its own or coupled with the storage container, back from the heating position to the loading position after a predetermined amount of time ($T_{HP}$). Thus, the device is configured to move the transfer element back to the loading position after such predetermined amount of time even though the user inhalation is still in progress.

This has the advantage that, in those embodiments where the transfer element acts as a lid or cover for the storage container and is movable on its own away from the outlet of the storage container, every time that liquid aerosol-forming substrate is transferred to the heating element, the outlet of the storage container effectively remains without a lid or cover only for an opening time ($T_O$) which corresponds to the sum of the predetermined amount of time (heating time, $T_{HP}$) and a time ($T_M$) required for moving the transfer element from the loading position to the heating position and back. The time ($T_M$) required for moving the transfer element can be determined to be short by selecting a suitable actuator and power source, and so the overall opening time ($T_O$) may be minimised to help prevent leaks from the storage container.

Further, this has the advantage that, because the movable transfer element stays operatively coupled with the heating element only for a predetermined, generally short, heating time ($T_{HP}$), the transfer element is unlikely to accumulate an excessive amount of heat that could be transferred to the storage container when the transfer element is back in the loading position (in the embodiments wherein the transfer element is movable on its own). In those embodiments wherein the transfer element is movable coupled with the storage container, it is also advantageous that the transfer element stays operatively coupled with the heating element for such a short period of time, since the amount of heat that can be supplied by conduction or convection to the transfer element and the storage container can thus be minimised.

In embodiments wherein the controller is configured to move the transfer element back from the heating position to the loading position after a predetermined heating time ($T_{HP}$), the controller may be configured to move the transfer element, on its own or coupled with the storage container, back and forth between the loading position and the heating position more than once, depending on one or more of the duration of the user inhalation, the amount of aerosol-forming substrate that can be loaded onto the transfer element and delivered to the heating element, the heating time ($T_{HP}$). By adjusting these parameters, it is advantageously possible to minimise the time effectively spent by the transfer element in the heating position whilst at the same time ensuring that an adequate amount of aerosol-forming substrate is aerosolised and delivered to the user during the inhalation.

In alternative embodiments, the controller may be configured to power the actuator such that the transfer element moves, on its own or coupled with the storage container, back from the heating position to the loading position based on detection of a change in air flow at a location in the device indicative of the end of a user inhalation.

In such embodiments, the amount of liquid aerosol-forming substrate transferred to the heating element will have to be generally greater and sufficient to ensure that the user can receive a sufficient amount of aerosol for the whole duration of the inhalation. On the other hand, movement of the transfer element between the loading position and the heating position may be slower than in the embodiments described above, which—in cases where the transfer element is movable on its own—may advantageously prevent droplets of liquid aerosol-forming substrate from being formed during movement of the transfer element.

In those embodiments wherein the transfer element is movable on its own, the transfer element may comprise a first end surface and a second end surface distal from the first end surface, the first end surface facing the storage container when the at least one of the transfer element and the heating element is in the loading position. In some embodiments, the device may be configured such that, when the at least one of the transfer element and the heating element is in the loading position, the first end surface of the transfer element faces the heating element.

Thus, one such device is configured to effectively rotate the transfer element about an axis thereof as it is moved between the loading position and the heating position. By way of example, where the transfer element extends between opposite, substantially flat end surfaces, the device is configured to rotate the transfer element by about 180 degrees while moving the transfer element between the loading position and the heating position. In such embodiments, the transfer element may have no through holes, which may be advantageous in that, when the transfer element lies against the outlet storage container, leaks of aerosol-forming substrate from the storage container may more effectively be prevented.

The opposite end surfaces of the transfer element may be suitable textured to reversibly attract and trap a liquid, such that it can be released to the heating element. By way of example, a surface of the transfer element may comprise a plurality of spikes.

Preferably, the device is configured to not rotate the transfer element back to its initial orientation while moving the transfer element back from the heating position to the loading position. Thus, when back in the loading position, the transfer element contacts the storage container on the side of the end surface that has not come into contact with the heating element. This may advantageously help prevent transferring heat, which will have been accumulated mostly on the opposite end surface of the transfer element, to the storage container.

In alternative embodiments, the transfer element may comprise at least one through conduit extending from the first end surface to the second end surface, and the device may be configured such that, when the at least one of the transfer element and the heating element is in the loading position, the second end surface of the transfer element faces the heating element.

This is advantageous in that movement of the transfer element as a whole is simplified as the liquid aerosol-forming substrate can be transferred through the at least one conduit, which can be facilitated by the kinetic energy transferred to the liquid substrate upon moving the transfer element. In some preferred embodiments, the transfer element may be provided in the form of a fluid-permeable element, such as a mesh. Even more preferably, both transfer element and heating element may be provided in the form of a fluid-permeable element. For example, both can be provided as meshes, the respective grids of the meshes being mutually arranged such that, when in the loading position, a wire of the mesh of the transfer element faces a gap between adjacent wires of the mesh of the heating element.

The mesh may be woven or non-woven. The mesh may be formed using different types of weave or lattice structures. The mesh may also be characterized by its ability to retain liquid.

In other embodiments, the heating element is movable to and from the storage container, the device being configured such that, when the heating element is in the loading position, the transfer element is operatively coupled with the heating element and liquid aerosol-forming substrate is supplied from the transfer element to the heating element.

Preferably, the heating element is movable independently of the storage container and the transfer element. In other words, as the heating element moves between the loading position and the heating position, the storage container and the transfer element preferably do not move with the heating element. In practice, the heating element alone is movable along the liquid supply path.

In such embodiments the heating element is provided as a fluid-permeable element, such as a mesh, or comprises a portion of high retention material (HRM) attached to a heating means, such that liquid aerosol-forming substrate can be carried away from the storage container and to the heating position. In practice, the heating element both moves aerosol-forming substrate away from the storage container and heats the aerosol-forming substrate so as to deliver aerosol to the user.

In some of these embodiments, the device may comprise an actuator for moving the heating element and a controller of the device is configured to monitor air flow at a location in the device, based on detection of a change in air flow indicative of a user inhalation, and to power the actuator such that the heating element moves from the heating position to the loading position and back, or from the loading position to the heating position. Further, the controller is configured to supply a predetermined amount of power to the heating element, the predetermined amount of power being sufficient for the heating element to vaporise liquid aerosol-forming substrate retained in the heating element.

In an alternative embodiment, the aerosol-generating device is configured such that the heating element is movable from the loading position to the heating position in response to a pressure change determined by a user inhalation. This may advantageously simplify the construction and operation of the device, such that there is no need for an electronically controlled actuator, but the heating element—which also performs the task of transporting liquid aerosol-forming substrate away from the storage container—is moved by a pneumatic or mechanical actuator in response to a pressure change caused by the user drawing air into and through the device.

In preferred embodiments, an aerosol-generating device in accordance with the invention comprises a controller connected to the at least one of the transfer element and the heating element, wherein the controller is configured to monitor changes in an electric property of the at least one transfer element and the heating element, the electric property being indicative of a change in the amount of liquid aerosol-forming substrate carried by the at least one of the transfer element and the heating element.

Preferably, in an aerosol-generating device in accordance with the invention, at least one of the heating element and the transfer element is fluid-permeable.

In an aerosol-generating device in accordance with the invention the transfer element is preferably adapted to receive and retain a predetermined amount of liquid aerosol-forming substrate from the storage container and capable of supplying the received predetermined amount of liquid aerosol-forming substrate to the heating element when operatively coupled with the heating element. This is advantageous in that, because a finite and known amount of aerosol-forming substrate is transferred from the storage container to the heating element every time that the transfer element is moved between such components, it is easy to control the amount of power supplied to the heating element such that it supplies a correspondingly finite and predetermined amount of heat to the aerosol-forming substrate the transfer element has carried from the storage container to the heating element. This enables a highly efficient management of the aerosol-generating device from a power consumption viewpoint, since the heating element may be powered to supply exactly the amount of heat necessary and sufficient for aerosolising only the predetermined amount of aerosol-forming substrate. Further, it has the consequence that the likelihood of the transfer element becoming overheated and of excessive heat being supplied to the storage container when the transfer element is moved back into the loading position may be significantly reduced.

Preferably, the predetermined amount of liquid aerosol-forming substrate is at least about 3 microlitres. More preferably, the predetermined amount of liquid aerosol-forming substrate is at least about 6 microlitres. In addition, or as an alternative, the predetermined amount of liquid aerosol-forming substrate is preferably less than about 30 microlitres.

The components of an aerosol-generating device in accordance with the present invention may be arranged in space according to several set-ups. Depending on how the storage container, the transfer element and the heating element are arranged in space with respect to one another, several spatial configurations of a liquid supply path are possible.

Different spatial arrangements of the various components of an aerosol-generating device in accordance with the present invention are possible. In some embodiments, the transfer element and the heating element are longitudinally aligned and a longitudinal distance between the transfer element and the heating element in the loading position is different from a longitudinal distance between the transfer element and the heating element in the heating position. In these embodiments, a liquid supply path can be identified that extends in the longitudinal direction between the outlet of the storage container and the heating element.

In general, where the transfer element is movable on its own or coupled with the storage container, the transfer element will be farther away from the heating element in the loading position than in the heating position. In those embodiments where the storage container moves along with the transfer element, a length of the liquid supply path will be smaller in the heating position than in the loading position. Where the heating element is movable, a longitudinal distance between the heating element and the transfer element in the loading position will be less than a longitudinal distance between the heating element and the transfer element in the heating position.

In other, alternative embodiments, the transfer element and the heating element are substantially concentrically arranged and a radial distance between the transfer element and the heating element in the loading position is different from a radial distance between the transfer element and the heating element in the heating position.

Figure 2:
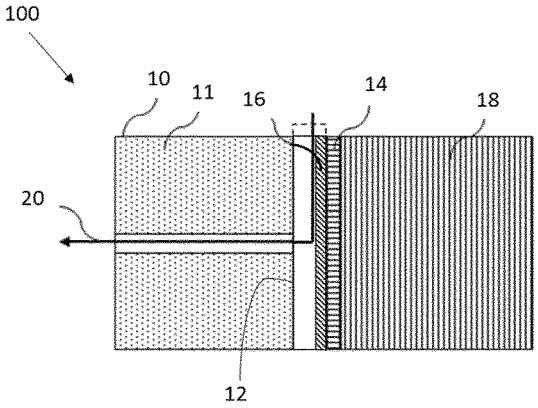
FIG. 2 shows a schematic, sectional side view of a detail of the aerosol-generating device of FIG. 1 in the heating position.

The aerosol-generating device 100 shown in FIGS. 1 and 2 comprises a storage container 10 containing a supply of a liquid aerosol-forming substrate, the storage container 10 having an outlet 12. Further, the device 100 comprises a heating element 14 longitudinally spaced from the storage container 10. The heating element 14 is adapted to vaporise the liquid aerosol-forming substrate to form an inhalable aerosol.

The aerosol-generating device 100 further comprises a transfer element 16 located between the storage container 10 and the heating element 14. The transfer element 16 is adapted to receive and retain liquid aerosol-forming substrate 11 from the storage container 10 and capable of being operatively coupled with the heating element 14 to supply the liquid aerosol-forming substrate received from the storage container 10 to the heating element 14. In the embodiment of FIGS. 1 and 1, a liquid supply path can be identified that extends from the outlet 12 of the storage container 10 to the heating element 14. Along such liquid supply path, the transfer element 16 is downstream of the storage container 10 and upstream of the heating element 14.

In more detail, the transfer element 16 is adapted to receive and retain a predetermined amount of liquid aerosol-forming substrate, namely about 3 microlitres, from the storage container 10 and capable of supplying such received predetermined amount of liquid aerosol-forming substrate to the heating element 14 when operatively coupled with the heating element 14.

In this embodiment, the transfer element 16 is movable between a loading position (as shown in FIG. 1) and a heating position (seen in FIG. 2). The aerosol-generating device of FIGS. 1 and 2 is configured such that: when the transfer element 16 is in the loading position, the transfer element 16 is in fluid communication with the outlet 12 of the storage container 10. When the transfer element 16 is in the heating position, the transfer element 16 is in fluid communication with the heating element 14 and the heating element is activated to vaporise liquid aerosol-forming substrate retained in the transfer element 16.

The aerosol-generating device of FIGS. 1 and 2 further comprises electronics 18 comprising a power supply and a controller, and an actuator (not shown) for moving the transfer element 16 between the storage container 10 and the heating element 14 along the liquid supply path. The controller is configured to monitor air flow at a location in the device 100 based on detection of a change in air flow indicative of a user inhalation (indicated schematically by the arrow in FIGS. 1 and 2); to power the actuator such that the transfer element 16 moves on its own from the loading position to the heating position; to supply a predetermined amount of power to the heating element 14, the predetermined amount of power being sufficient for the heating element to vaporise the liquid aerosol-forming substrate retained in the transfer element 16.

Figure 3:
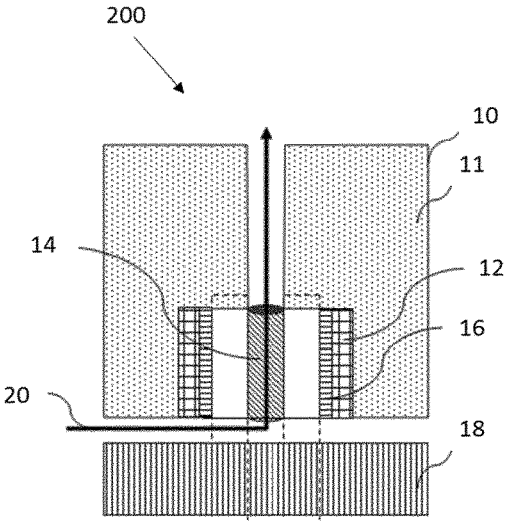
FIG. 3 shows a schematic, sectional side view of a detail of an aerosol-generating device according to an alternative embodiment of an aerosol-generating device in accordance with the present invention.

Reference numeral 200 in FIG. 3 identifies another embodiment of an aerosol-generating device in accordance with the present invention. The device 200 differs from the device 100 for the spatial arrangement of the various components of the device. As will be described in more detail below, in this embodiment the transfer element 16 and the heating element 14 are substantially concentrically arranged, and a radial distance between the transfer element 16 and the heating element 14 in the loading position is different from a radial distance between the transfer element 16 and the heating element 14 in the heating position. For the sake of clarity, wherever possible, the same numerals will be used in the following description to identify components of the device 200 corresponding structurally and functionally to the components of the device 100.

Figure 4:
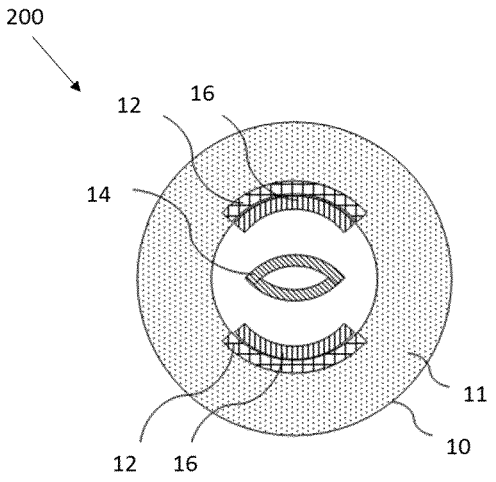
FIGS. 4 and 5 shows schematic, sectional top views of a detail of the aerosol-generating device of FIG. 3 in the loading position and the heating position, respectively.
Figure 5:
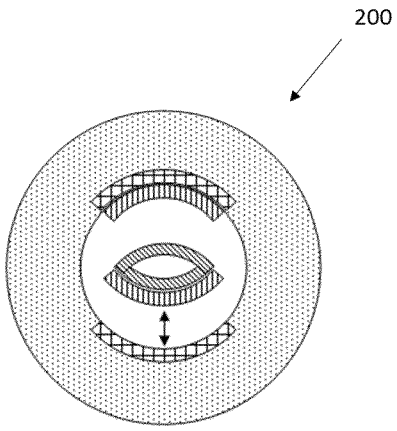

The aerosol-generating device 200 comprises a storage container 10 containing a supply of a liquid aerosol-forming substrate, the storage container 10 having two outlets 12. As seen in FIGS. 4 and 5, the storage container 10 has an annular cross-section. Further, the device 200 comprises a heating element 14 arranged centrally and radially spaced from the outlets 12 of the storage container 10. The heating element 14 is adapted to vaporise the liquid aerosol-forming substrate to form an inhalable aerosol.

The aerosol-generating device 200 further comprises a pair of transfer elements 16 located at a radially intermediate position between the storage container 10 and the heating element 14. The transfer elements 16 are adapted to receive and retain liquid aerosol-forming substrate from the storage container 10 and capable of being operatively coupled with the heating element 14 to supply the liquid aerosol-forming substrate received from the storage container 10 to the heating element 14.

In this embodiment, both transfer elements 16 are movable between a loading position (as shown in FIG. 4) and a heating position (seen in FIG. 5). The aerosol-generating device of FIGS. 3-4-5 is configured such that: when the transfer elements 16 are in the loading position, the transfer elements 16 are in fluid communication with the outlets 12 of the storage container 10. When the transfer element 16 are in the heating position, the transfer elements 16 are in fluid communication with the heating element 14 and the heating element is activated to vaporise liquid aerosol-forming substrate retained in the transfer elements 16.

The invention claimed is:

1. An aerosol-generating device, comprising:

a storage container containing a supply of a liquid aerosol-forming substrate, the storage container having an outlet;

a heating element spaced from the storage container, the heating element being configured to vaporise the liquid aerosol-forming substrate to form an inhalable aerosol; and a transfer element disposed between the storage container and the heating element, the transfer element being configured to receive and retain the liquid aerosol-forming substrate from the storage container, and to be operatively coupled with the heating element to supply the received liquid aerosol-forming substrate to the heating element, wherein the transfer element is movable on its own along a liquid supply path between a loading position and a heating position, the transfer element being movable independently of the storage container, such that, as the transfer element moves between the loading position and the heating position, the storage container does not move with the transfer element, wherein the aerosol-generating device is configured such that:

when the transfer element is in the loading position, the transfer element is in fluid communication with the outlet of the storage container, or with the outlet of the storage container and with the heating element, and when the transfer element is in the heating position, the transfer element is in fluid communication with the heating element, and the heating element is activated to vaporise liquid aerosol-forming substrate retained in the transfer element, and wherein the transfer element and the heating element are longitudinally aligned, and a longitudinal distance between the transfer element and the heating element in the loading position is greater than a longitudinal distance between the transfer element and the heating element in the heating position, or the transfer element and the heating element are substantially concentrically arranged, and a radial distance between the transfer element and the heating element in the loading position is greater than a radial distance between the transfer element and the heating element in the heating position.

2. The aerosol-generating device according to claim 1, wherein the transfer element is movable between the storage container and the heating element, and the aerosol-generating device being further configured such that, when the transfer element is in the heating position, the transfer element is operatively coupled with the heating element and liquid aerosol-forming substrate retained in the transfer element is supplied to the heating element.

3. The aerosol-generating device according to claim 2, further comprising:

a power supply;

a controller; and an actuator configured to move the transfer element along the liquid supply path, wherein the controller is configured to:

monitor air flow at a location in the aerosol-generating device based on detection of a change in air flow indicative of a user inhalation, power the actuator such that the transfer element moves from the loading position to the heating position, and power the heating element to vaporise the liquid aerosol-forming substrate retained in the transfer element.

4. The aerosol-generating device according to claim 3, wherein the controller is further configured to power the actuator such that the transfer element moves back from the heating position to the loading position after a predetermined amount of time.

5. The aerosol-generating device according to claim 3, wherein the controller is further configured to power the actuator such that the transfer element moves back from the heating position to the loading position based on detection of the change in air flow at the location in the device indicative of an end of the user inhalation.

6. The aerosol-generating device according to claim 1, wherein the transfer element comprises a first end surface and a second end surface distal from the first end surface, the first end surface facing the storage container when at least one of the transfer element and the heating element is in the loading position.

7. The aerosol-generating device according to claim 6, wherein the aerosol-generating device is further configured such that, when the transfer element is in the loading position, the first end surface of the transfer element faces the heating element.

8. The aerosol-generating device according to claim 6, wherein the transfer element further comprises at least one through conduit extending from the first end surface to the second end surface, and wherein the aerosol-generating device is further configured such that, when the transfer element is in the loading position, the second end surface of the transfer element faces the heating element.

9. The aerosol-generating device according to claim 1, further comprising a controller connected to at least one of the transfer element and the heating element, wherein the controller is configured to monitor changes in an electric property of the at least one of the transfer element and the heating element indicative of a change in an amount of the liquid aerosol-forming substrate carried by at least one of the transfer element and the heating element.

10. The aerosol-generating device according to claim 1, wherein at least one of the heating element and the transfer element is fluid-permeable.

11. The aerosol-generating device according to claim 1, wherein the transfer element is configured to:

receive and retain a predetermined amount of the liquid aerosol-forming substrate from the storage container, and supply the received predetermined amount of the liquid aerosol-forming substrate to the heating element when operatively coupled with the heating element.

12. The aerosol-generating device according to claim 11, wherein the predetermined amount of the liquid aerosol-forming substrate is at least about 3 microlitres.

* * * * *